US011072762B2

(12) United States Patent
Hong

(10) Patent No.: US 11,072,762 B2
(45) Date of Patent: Jul. 27, 2021

(54) ECO-FRIENDLY CLEANING AGENT FOR METAL MEMBER AND METHOD OF PREPARING THE SAME

(71) Applicants: Hyundai Motor Company, Seoul (KR); Kia Motors Corporation, Seoul (KR)

(72) Inventor: Chae Hwan Hong, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 90 days.

(21) Appl. No.: 16/209,232

(22) Filed: Dec. 4, 2018

(65) Prior Publication Data

US 2020/0056119 A1 Feb. 20, 2020

(30) Foreign Application Priority Data

Aug. 20, 2018 (KR) ..... 10-2018-0096617

(51) Int. Cl.

| | |
|---|---|
| ***C11D 1/38*** | (2006.01) |
| ***C11D 1/62*** | (2006.01) |
| ***C11D 1/72*** | (2006.01) |
| ***C11D 3/22*** | (2006.01) |
| ***C11D 3/33*** | (2006.01) |
| ***C11D 3/43*** | (2006.01) |
| ***C11D 11/00*** | (2006.01) |
| ***C11D 1/42*** | (2006.01) |

(52) U.S. Cl.

CPC ..... *C11D 3/221* (2013.01); *C11D 1/42* (2013.01); *C11D 3/33* (2013.01); *C11D 3/43* (2013.01); *C11D 11/0029* (2013.01)

(58) Field of Classification Search

CPC .... C11D 1/38; C11D 1/62; C11D 1/72; C11D 3/2075; C11D 3/2086; C11D 3/22; C11D 3/221; C11D 3/33; C11D 3/43; C11D 11/00

See application file for complete search history.

(56) References Cited

U.S. PATENT DOCUMENTS

2019/0226094 A1* 7/2019 Felipe ..... C11D 7/265

FOREIGN PATENT DOCUMENTS

| | | | | |
|---|---|---|---|---|
| KR | 100642123 B1 | | 10/2006 | |
| KR | 101709303 B1 | | 2/2017 | |
| WO | WO 2018/007298 | * | 1/2018 | ..... C11D 3/20 |
| WO | WO 2018/080836 | * | 5/2018 | ..... C11D 1/65 |

* cited by examiner

*Primary Examiner* — Brian P Mruk

(74) *Attorney, Agent, or Firm* — Mintz Levin Cohn Ferris Glovsky and Popeo, P.C.; Peter F. Corless

(57) ABSTRACT

Disclosed is a cleaning agent for a metal member that may include an amount of about 15 wt % to 30 wt % of an organic acid derived from a monosaccharide, or a salt thereof, an amount of about 0.8 wt % to 1.2 wt % of a chelating agent, an amount of about 0.2 wt % to 0.4 wt % of a surfactant and an amount of about 75 wt % to 85 wt % of a solvent, based on the total weight of the cleaning agent. The acid cleaning agent may be prepared using, as a main material, an organic acid mixture including potassium glucarate, thus exhibiting superior acid cleaning capability and minimizing the generation of offensive odors. The cleaning agent of the present invention may be eco-friendly because the working environment using the same is made comfortable.

15 Claims, 1 Drawing Sheet

ECO-FRIENDLY CLEANING AGENT FOR METAL MEMBER AND METHOD OF PREPARING THE SAME

CROSS-REFERENCE TO RELATED APPLICATION

This application claims under 35 U.S.C. § 119(A) the benefit of priority to Korean Patent Application No. 10-2018-0096617 filed on Aug. 20, 2018, the entire contents of which are incorporated herein by reference.

TECHNICAL FIELD

The present invention relates to a cleaning agent, for example, an eco-friendly cleaning agent for a metal member. Particularly, the cleaning agent may include an organic acid or a salt thereof.

BACKGROUND OF THE INVENTION

In the related arts, when a metal member is exposed in air for a long period of time, the surface thereof is oxidized and is covered with an oxide film layer. For example, a thick oxide film layer scale is formed on the surface of a metal member subjected to heat treatment or hot rolling. Furthermore, a deformed layer is formed on the surface of a metal member subjected to mechanical processing.

In order to perform a secondary processing such as plating on the metal member having the oxide film layer or deformed layer formed on the surface thereof, the impurity layer such as the oxide film layer or deformed layer has to be removed from the surface of the metal member, and the surface of the metal member has to be cleaned in order to remove the impurity layer.

When the metal member, particularly a steel member subjected to heat treatment at a high temperature, is cleaned, the oxide scale formed on the surface of the steel member may have a porous triple-layer structure including an outer layer of $\alpha$-$Fe_2O_3$, a middle layer of $Fe_3O_4$, and an inner layer of FeO. When this steel member is dipped in a sulfuric solution or hydrochloric acid solution and thus pickled, the oxide scale formed on the surface of the steel member is dissolved and thus removed, but the sulfuric solution or hydrochloric acid solution may penetrate into the matrix of the steel member, and thus local cells may be generated between the steel and the oxide scale, undesirably dissolving the steel and generating hydrogen gas on the oxide surface.

In the related arts, the pickling has been typically performed using a 5 to 10 wt % sulfuric acid or hydrochloric acid solution. However, when such a solution is used, bad odors are generated due to the generation of harmful gas, which is harmful to the health of workers, and thus the pickling process has not been frequently used. Furthermore, when the solution after the pickling process is discharged as it is to the outside, it may cause water pollution and may destroy the natural environment.

For instance, in repair shops that repair vehicles, cleaning agents have been generally used to clean vehicle parts or remove grease generated by lubricating oil or fossil fuels, and such grease may be easily dissolved in solvents or oil solvents such as TCE (Trichloroethylene). Hence, solvents or TCE have been widely useful as cleaning agents.

However, since the cleaning agent such as solvents or TCE as above contains methylcyclohexane, which is harmful to the human body and to the environment, the use thereof has been restricted or avoided. Hence, it is necessary to develop a cleaning agent having eco-friendly and harmless, and exhibiting superior cleaning capability, which may replace the organic solvents.

SUMMARY OF THE INVENTION

In preferred aspects, the present invention may provide a cleaning agent, or an eco-friendly cleaning agent, which may have equivalent or improved performance compared to conventional cleaning agents for cleaning metal members and may minimize the generation of offensive odors, and a method of preparing the same.

In one aspect, provided is a cleaning composition (or "an eco-friendly cleaning agent composition") for a metal member. The cleaning agent may include an organic acid derived from a monosaccharide, or a salt thereof, a chelating agent, and a surfactant. In certain aspects, the cleaning agent composition suitably may further include one or more solvents that are distinct or different from the organic acid, or a salt thereof, the chelating agent and the surfactant.

The term "organic acid" as used herein refers to an organic compound having acidic property, for example, by containing one or more functional group that can be ionized in water or an aqueous solution. Exemplary organic acid may suitably include carboxyl group (—COOH), sulfonic acids (e.g., —$SO_2OH$), alcohols (—OH) or thiol (—SH). Preferred organic acid may suitably include one or more carboxyl group, which may be ionized to produce —$COO^-$ end. In certain embodiments, the organic acid containing ionized group (e.g., —$COO^-$) may be in a "salt" form together with a cation such as a metal ion (e.g., $Na^+$, $K^+$, $Ca^{2+}$ or $Mg^{2+}$) or ammonium ion ($NH_4^+$).

The term "monosaccharide" as used herein refers to a molecule constituting carbohydrates (e.g., disaccharide or polysaccharide) and having a general formula of $C_nH_{2n}O_n$ when n is an integer. The monosaccharide can either have a linear form or a ring (cyclic) form, and n may suitably range from 3 to 7, such that non-limiting examples of the monosaccharides may include triose, tetrose, pentose, hexose, or heptose. Preferably, the monosaccharide that is used for an organic acid derivative or a salt thereof may be hexose such as allose, altrose, glucose, mannose, gulose, idose, galactose and talose, which may be D- or L-configuration in linear or cyclic form.

An organic acid may be considered as "derived" from a monosaccharide where a chemical reaction, for example, substitution, alkylation, hydrolysis, tautomerization, oxidation, reduction, hydration, dehydration, solvation, or the like occurs.

The term "chelating agent" as used herein refers to a molecule that may bond or substantially bond to metal ions (e.g., transition metal ions) via one or more binding sites (e.g., ionic bonds or covalent bonds). The chelating agent may suitably include a ligand, or an organic molecule, which may include non-metallic atoms such as O, N, S, or P, donating electrons to the metal ions.

The term "surfactant" as used herein refers to an agent or compound which may reduce surface tension between interfaces of two different phases, for example, between two liquids (hydrophilic and hydrophobic liquids), between a gas and a liquid, or between a liquid and a solid. Preferred surfactant may include both hydrophilic and hydrophobic groups such that suspension of admixture or liquid mixtures may be promoted.

The cleaning agent composition may further include one or more solvents that may be different from the organic acid derived from a monosaccharide, or a salt thereof, the chelating agent and the surfactant.

The monosaccharide may suitably include one or more selected from the group consisting of glucose and galactose.

The salt of the organic acid may include metal ions, for example, the salt of the organic acid may include potassium ($K^+$) bound to an end thereof.

The organic acid, or the salt thereof may include one or more selected from the group consisting of glucaric acid, potassium glucarate, galactaric acid, and potassium galactarate.

The chelating agent may suitably include one or more selected from the group consisting of citric acid, oxalic acid, malic acid, glycine, alanine, glutamic acid, aminobutyric acid, ethylenediamine tetraacetic acid, cyclohexanediamine tetraacetic acid, iminodiacetic acid, nitrilotriacetic acid, diethylene trinitrile pentaacetic acid, aminotris(methylene phosphonic acid), (1-hydroxyethane-1,1-diyl)bis(phosphonic acid), ethylenediamine tetra(methylene phosphonic acid), and diethylenetriamine penta(methylene phosphonic acid).

The chelating agent may suitably include ethylenediamine tetraacetic acid.

The surfactant may suitably include a cationic surfactant.

The surfactant may suitably include a polyoxyethylene-based surfactant.

The surfactant may suitably include one or more selected from the group consisting of polyoxyethylene alkylether, and polyoxyethylene alkylphenylether.

The surfactant may suitably include one or more selected from the group consisting of dodecyltrimethylammonium bromide (DATB), cetyltrimethylammonium chloride (CTAC), hexadecylpyridinium bromide (HDPB), benzylcetyldimethylammonium chloride (BCDA), and polyoxyethylene nonylphenyl ether.

According to an exemplary embodiments, the cleaning agent may include an amount of about 15 wt % to 30 wt % of the organic acid, or the salt thereof, an amount of about 0.8 wt % to 1.2 wt % of the chelating agent, an amount of about 0.2 wt % to 0.4 wt % of the surfactant and an amount of about 75 wt % to 85 wt % of the solvent, all the wt % based on the total weight of the cleaning agent composition.

In another aspect, provided is a method of preparing a cleaning agent composition for a metal member. The method may include: producing a reaction admixture comprising a solvent, a monosaccharide, and potassium hydroxide (KOH); synthesizing an organic acid, or a salt thereof by reacting the reaction admixture with a metal catalyst in the presence of oxygen gas; and preparing the cleaning agent including the organic acid, or a salt thereof, a chelating agent, a surfactant and the solvent.

Preferably, the reacting may include an oxidation reaction of the monosaccharides in the presence of the oxygen gas.

The solvent may suitably be a polar solvent. Preferably, the solvent may be water.

The monosaccharide may suitably include one or more selected from the group consisting of glucose and galactose.

The metal catalyst may include a metal element supported on a support including one or more selected from the group consisting of carbon, silica, and alumina. The term "support" as used herein refers to a solid material having a rigid or substantially rigid surface to which active material or catalyst material such as a metal element (e.g., metal element including noble metals or transition metals).

The metal element may suitably include one or more selected from the group consisting of platinum, rhodium, palladium, and nickel.

Preferably, the reaction mixture may include the monosaccharide at a concentration of about 0.02 g/cc to 0.2 g/cc relative to the solvent.

The reaction admixture may suitably include an amount of about 0.9 parts by weight to 1.5 parts by weight of the potassium hydroxide based on 100 parts by weight of the monosaccharide.

Preferably, an amount of about 0.3 parts by weight to 0.5 parts by weight of the metal catalyst based on 100 parts by weight of the monosaccharide may be reacted with the reaction admixture.

The reaction admixture may be suitably oxidized at a pressure of about 1 bar to 5.0 bar and a temperature of about 30° C. to 50° C. for about 3 hr to 6 hr.

A resulting product after the reacting, or particularly the oxidation, may have a hydrogen ion concentration of about pH 3 to pH 4.

According to various exemplary embodiments of the present invention, a cleaning agent may be prepared using potassium glucarate as a main component, thus obtaining a cleaning agent composition that may have superior cleaning capability. Additionally, generation of offensive odors may be minimized, such that the cleaning agent composition may be eco-friendly and waste generated after the cleaning the metal member may be managed easily.

Other aspects of the present invention are disclosed infra.

DETAILED DESCRIPTION

Figure 1:
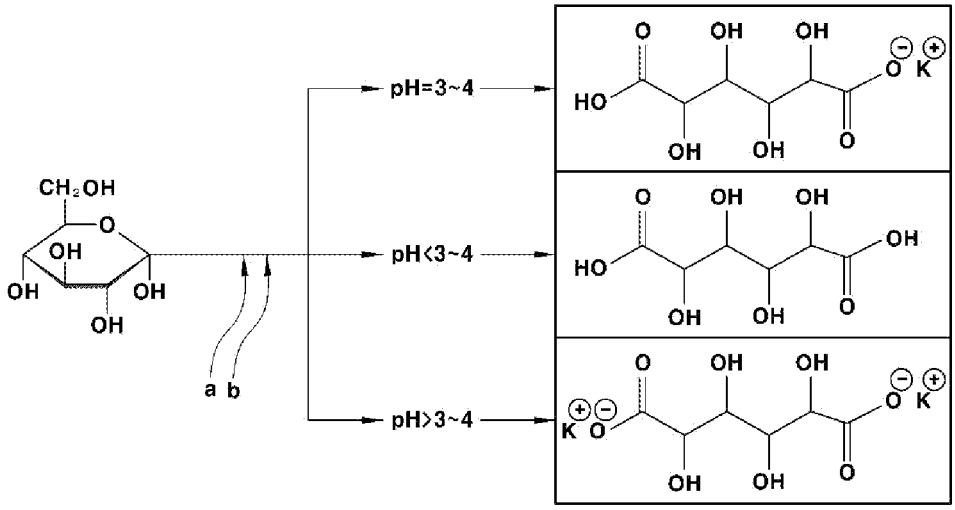
FIG. 1 shows an exemplary process of synthesizing an exemplary organic acid from glucose.

The above and other aspects, features and advantages of the present invention will be more clearly understood from the following preferred embodiments taken in conjunction with the accompanying drawings. However, the present invention is not limited to the embodiments disclosed herein, and may be modified into different forms. These embodiments are provided to thoroughly explain the invention and to sufficiently transfer the spirit of the present invention to those skilled in the art.

Throughout the drawings, the same reference numerals will refer to the same or like elements. For the sake of clarity of the present invention, the dimensions of structures are depicted as being larger than the actual sizes thereof. It will be understood that, although terms such as "first", "second", etc. may be used herein to describe various elements, these elements are not to be limited by these terms. These terms are only used to distinguish one element from another element. For instance, a "first" element discussed below could be termed a "second" element without departing from the scope of the present invention. Similarly, the "second" element could also be termed a "first" element. As used herein, the singular forms are intended to include the plural forms as well, unless the context clearly indicates otherwise.

It will be further understood that the terms "comprise", "include", "have", etc., when used in this specification, specify the presence of stated features, integers, steps, operations, elements, components, or combinations thereof, but do not preclude the presence or addition of one or more other features, integers, steps, operations, elements, components, or combinations thereof. Also, it will be understood that when an element such as a layer, film, area, or sheet is referred to as being "on" another element, it can be directly on the other element, or intervening elements may be present therebetween. In contrast, when an element such as a layer, film, area, or sheet is referred to as being "under" another element, it can be directly under the other element, or intervening elements may be present therebetween.

Unless otherwise specified, all numbers, values, and/or representations that express the amounts of components, reaction conditions, polymer compositions, and mixtures used herein are to be taken as approximations including various uncertainties affecting the measurements that essentially occur in obtaining these values, among others, and thus should be understood to be modified by the term "about" in all cases. For example, unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Furthermore, when a numerical range is disclosed in this specification, the range is continuous, and includes all values from the minimum value of said range to the maximum value thereof, unless otherwise indicated. Moreover, when such a range pertains to integer values, all integers including the minimum value to the maximum value are included, unless otherwise indicated.

In the present specification, when a range is described for a variable, it will be understood that the variable includes all values including the end points described within the stated range. For example, the range of "5 to 10" will be understood to include any subranges, such as 6 to 10, 7 to 10, 6 to 9, 7 to 9, and the like, as well as individual values of 5, 6, 7, 8, 9 and 10, and will also be understood to include any value between valid integers within the stated range, such as 5.5, 6.5, 7.5, 5.5 to 8.5, 6.5 to 9, and the like. Also, for example, the range of "10% to 30%" will be understood to include any subranges, such as 10% to 15%, 12% to 18%, 20% to 30%, etc., as well as all integers including values of 10%, 11%, 12%, 13% and the like up to 30%, and will also be understood to include any value between valid integers within the stated range, such as 10.5%, 15.5%, 25.5%, and the like.

The present invention pertains to an eco-friendly cleaning agent composition for a metal member and to a method of preparing the same, in which the eco-friendly cleaning agent for a metal member contains an organic acid, the organic acid being derived from hexose as a monosaccharide.

Hereinafter, a detailed description will be given of the present invention.

In an aspect, a cleaning agent composition ("eco-friendly cleaning agent composition" or "composition") for a metal member may include an organic acid derived from a monosaccharide, or a salt thereof, a chelating agent, a surfactant and a solvent.

Preferably, the organic acid or the salt thereof may be included in an amount of about 15 wt % to 30 wt % based on the total weight of the cleaning agent composition. When the amount of the organic acid or the salt thereof is less than about 15 wt %, rust or grease attached to the surface of the metal member may not be efficiently cleaned. On the other hand, when the amount of the organic acid or the salt thereofis greater than about 30 wt %, cleaning capability may not be sufficiently improved, thus negating economic benefits.

Preferably, the monosaccharide may include hexose, which has six carbon atoms, which may be substituted or unsubstituted. The hexose may suitably include one or more selected from the group consisting of glucose and galactose.

The organic acid, or the salt thereof may include one or more selected from the group consisting of glucaric acid, potassium glucarate, galactaric acid, and potassium galactarate.

Preferably, the organic acid or the salt thereof may be added to the solvent, together with potassium hydroxide (KOH) and a metal catalyst. Subsequently, an oxidation reaction may be carried out, such that the glucose or galactose may be converted into glucaric acid, potassium glucarate, galactaric acid or potassium galactarate. Preferably, the hexose may suitably be glucose, and thus formed organic acid salt may be potassium glucarate. The potassium glucarate may include a potassium cation ($K^+$) in a salt form.

The metal catalyst may suitably include a metal element including one or more selected from the group consisting of platinum, rhodium, palladium, and nickel. Preferably, the metal element may be supported on a support including one or more selected from the group consisting of carbon, silica, and alumina.

Preferably, the solvent may be a polar solvent including water. For example, the solvent may be water.

Preferably, the chelating agent may be included in an amount of 0.8 wt % to 1.2 wt % based on the total weight of the cleaning composition. When the amount of the chelating agent is less than about 0.8 wt %, sufficient chelating effects may not be exhibited, and thus acid cleaning capability may deteriorate. On the other hand, when the amount of the chelating agent is greater than about 1.2 wt %, chelating effects may not sufficiently increased despite an increase in the amount of the chelating agent, thus negating economic benefits.

The chelating agent may include one or more selected from the group consisting of citric acid, oxalic acid, malic acid, glycine, alanine, glutamic acid, aminobutyric acid, ethylenediamine tetraacetic acid, cyclohexanediamine tetraacetic acid, iminodiacetic acid, nitrilotriacetic acid, diethylene trinitrile pentaacetic acid, aminotris(methylene phosphonic acid), (1-hydroxyethane-1,1-diyl)bis(phosphonic acid), ethylenediamine tetra(methylene phosphonic acid), and diethylenetriamine penta(methylene phosphonic acid). Preferably, the chelating agent may suitably include ethylenediamine tetraacetic acid.

The surfactant may suitably be included contained in an amount of about 0.2 wt % to 0.4 wt % based on the total weight of the cleaning composition. When the amount of the surfactant is less than about 0.2 wt %, the surface tension of the cleaning agent composition may decrease due to the lack of the surfactant, and thus the cleaning capability may deteriorate. On the other hand, when the amount of the surfactant is greater than about 0.4 wt %, the surface tension may increase but the cleaning capability is not further enhanced.

The surfactant may suitably include a cationic surfactant.

For instance, the surfactant may suitably include a polyoxyethylene-based surfactant, and may include one or more selected from the group consisting of polyoxyethylene alkylether, and polyoxyethylene alkylphenylether. In addition, the surfactant may include one or more selected from the group consisting of dodecyltrimethylammonium bromide (DATB), cetyltrimethylammonium chloride (CTAC), hexadecylpyridinium bromide (HDPB), benzylcetyldimethylammonium chloride (BCDA), and polyoxyethylene nonylphenyl ether.

The solvent may be contained in an amount of about 75 wt % to 85 wt % based on the total weight of the cleaning composition. When the amount of the solvent is less than about 75 wt %, the relative concentrations of the other components may be increased, thus negating economic benefits. Furthermore, cleaning capability may deteriorate or long-term storage may become difficult. On the other hand, when the amount of the solvent is greater than about 85 wt %, the relative concentrations of the other components may be decreased, and thus the cleaning capability may deteriorate. The solvent may suitably be a polar solvent, which may include water. Preferably, the solvent may be water.

In another aspect, provided is a method of preparing a cleaning agent composition for a metal member. The method may include: producing a reaction admixture including a solvent, a monosaccharide and potassium hydroxide (KOH); synthesizing an organic acid by reacting the reaction admixture with a metal catalyst in the presence of oxygen gas; and preparing the cleaning agent composition including the organic acid, a chelating agent, a surfactant and the solvent.

The monosaccharide may suitably include a hexose and the hexose may suitably include one or more selected from the group consisting of glucose and galactose.

For instance, the hexose may be glucose, the organic acid, or the salt thereof may be synthesized in the form of glucaric acid or potassium glucarate. When the hexose is galactose, the organic acid or the salt thereof may be synthesized in the form of galactaric acid or potassium galactarate.

An exemplary process of obtaining glucaric acid is described below.

FIG. 1 shows an exemplary process of converting glucose as the hexose into an exemplary organic acid of the present invention through catalytic oxidation. For instance, glucose, having a hexagonal shape, may be added to water, as a solvent, together with potassium hydroxide (KOH) (a) and a metal catalyst (b) in the presence of oxygen gas, after which an oxidation reaction may be induced, thus obtaining an organic acid or a salt thereof. The type of organic acid that is obtained may vary depending on the hydrogen ion concentration of the reaction conditions. For instance, at a pH of about 3 to 4, glucaric acid in which a potassium cation ($K^+$) is present in the form of a salt at only one end thereof may be obtained. When the pH is less than about 3, glucaric acid in which a potassium cation ($K^+$) is not present in the form of a salt may be obtained. On the other hand, when the pH is greater than about 4, glucaric acid in which a potassium cation ($K^+$) is present in the form of a salt at both ends thereof may be obtained. Preferably, the organic acid may be glucaric acid (potassium glucarate), and its salt may include a potassium cation ($K^+$) at only one end thereof.

The synthesized organic acid may be added to the solvent, together with a chelating agent and a surfactant, and mixed therewith, thus obtaining a cleaning agent composition for a metal member.

For instance, the cleaning agent composition may include the organic acid or a salt thereof in an amount of about 15 wt % to 30 wt % as being added to the solvent, the chelating agent in an amount of about 0.8 wt % to 1.2 wt %, and the surfactant in an amount of about 0.2 wt % to 0.4 wt % based on the total weight of the cleaning agent composition. In addition, the composition may suitably include the solvent in an amount of about 75 wt % to 85 wt % based on the total weight of the cleaning agent composition.

A detailed description of the chelating agent, the surfactant and the solvent is as described above, and is thus omitted in order to avoid the redundant description.

EXAMPLE

A better understanding of the present invention will be given through the following examples, which are merely set forth to illustrate the present invention but are not to be construed as limiting the scope of the present invention.

Preparation Example

Preparation of Potassium Glucarate

As a starting material, glucose (hydrous glucose, Daesang, Korea) was placed at a concentration of 0.1 g/cc relative to water, serving as a solvent, in a reactor, and potassium hydroxide (Sigma Aldrich, USA) was added in an amount of 0.9 parts by weight based on the amount of glucose. Thereafter, a platinum catalyst (Sigma Aldrich, USA) loaded on activated carbon was added in an amount of 0.3 parts by weight based on the amount of glucose. Thereafter, the reactor temperature was maintained at 50° C., and oxygen gas was fed into the reactor such that the pressure was maintained at about 1 bar, and the reaction was performed for 4 hr. Here, the hydrogen ion concentration was maintained at a pH of 4.

After completion of the reaction, potassium glucarate, which is an organic acid salt including potassium ($K^+$) is bound to the end thereof, was obtained.

Figure 2:
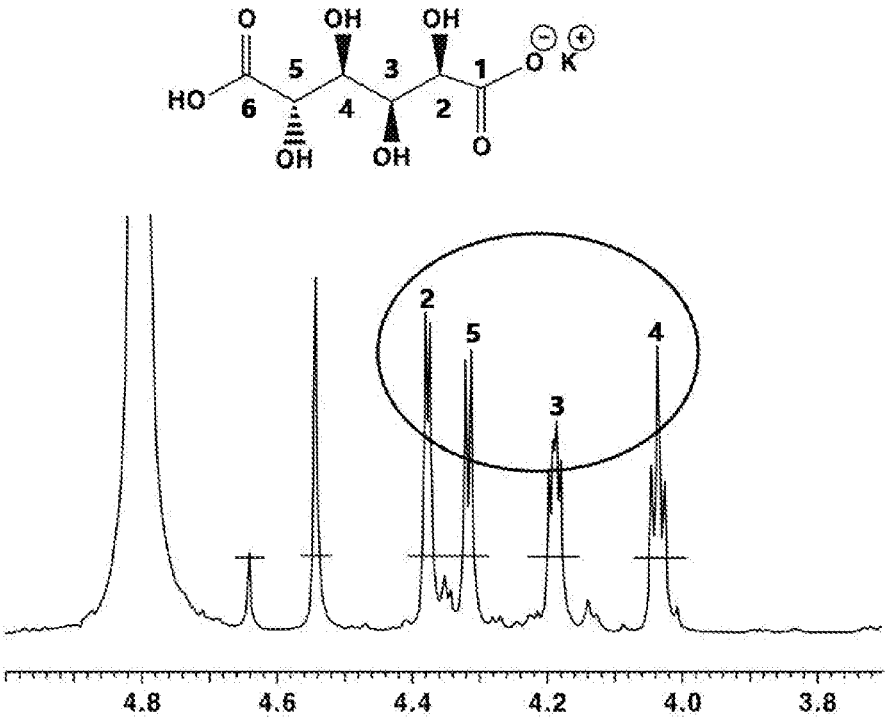
FIG. 2 shows $^1$H-NMR data of glucaric acid prepared according to an exemplary embodiment of the present invention.

FIG. 2 shows $^1$H-NMR data of glucaric acid. In the $^1$H-NMR graph, the peak at 4.39 on the X-axis represents the 2-position hydrogen of potassium glucarate, the peak at 4.32 represents the 5-position hydrogen of potassium glucarate, the peak at 4.19 represents the 3-position hydrogen of potassium glucarate, and the peak at 4.03 represents the 4-position hydrogen of potassium glucarate. The $^1$H-NMR graph including the peaks at the above four positions shows that potassium glucarate, which is an organic acid salt including potassium ($K^+$) is bound to one end thereof, was synthesized.

Examples

Examples 1 to 5 and Comparative Examples 1 to 8

Respective cleaning agents of Examples 1 to 5 and Comparative Examples 1 to 8 were prepared using the components in the amounts shown in the following Table 1. Here, the chelating agent was ethylenediamine tetraacetic acid (EDTA), and the surfactant was polyoxyethylene nonylphenyl ether. Also in Comparative Examples, sulfuric acid having a purity of 60% and hydrochloric acid having a purity of 20% were used. In an exemplary preparation method, water and potassium glucarate were mixed in the amounts shown in Table 1 and stirred at a rotating steed of 3000 rpm using a high-speed stirrer, thus preparing a mixed solution. Thereafter, a surfactant and EDTA were added in the amounts shown in Table 1, thereby producing a final product.

TABLE 1

| | Example | | | | | Comparative Example | | | | | | | |
|---|---|---|---|---|---|---|---|---|---|---|---|---|---|
| Component | 1 | 2 | 3 | 4 | 5 | 1 | 2 | 3 | 4 | 5 | 6 | 7 | 8 |
| Potassium glucarate | 16 | 15 | 20 | 30 | 30 | 0 | 0 | 5 | 10 | 16 | 15 | 10 | 40 |
| Sulfuric acid | | | | | | 9 | | | | | | | |
| Hydrochloric acid | | | | | | | 9 | | | | | | |
| EDTA | 0.8 | 1.2 | 0.8 | 1.2 | 0.8 | 0.8 | 0.8 | | | 0.4 | 2.0 | 0.8 | 0.8 |
| Surfactant | 0.3 | 0.3 | 0.3 | 0.3 | 0.3 | 0.3 | 0.3 | | | 0.3 | 0.3 | 0.3 | 0.3 |
| Water | 82.9 | 83.5 | 78.9 | 68.5 | 68.9 | 87.9 | 87.9 | 95 | 90 | 83.3 | 82.7 | 63.9 | 58.9 |

Test Examples

A metal member sample having thereon an oxide film having a thickness of 2 μm was dipped at room temperature for 5 min in the composition of each of Examples 1 to 5 and Comparative Examples 1 to 8, taken out thereof, dried, and then allowed to stand for 1 hr, after which the surface of the metal member was observed. The results are shown in the following Table 2.

In order to evaluate the ability to remove lubricating oil and grease, a metal member sample, obtained by artificially attaching lubricating oil and grease to the surface of the metal member sample, was dipped for 5 min, taken out thereof, dried, and then allowed to stand for 1 hr, after which the surface of the metal member was observed. The results are shown in Table 2 below. Here, the metal member sample used was a steel plate (cold-rolled steel plate) having thereon an oxide film having a thickness of 2 μm.

low, and in Comparative Example 6, the results were similar to those of Examples despite an increase in the amount of the chelating agent.

Comparative Examples 7 and 8 were conducted under the same test conditions as in Example 1, except for the amount of potassium glucarate as the organic acid. In Comparative Example 7, using potassium glucarate in an amount less than the lower limit of the range, for example, less than about 15 wt %, the ability to remove the oxide film layer, lubricating oil and grease was substantially decreased. Moreover, as shown in Comparative Example 8, using potassium glucarate in an amount greater than the upper limit of the range, e.g., greater than about 30 wt %, the ability to remove the oxide film layer, lubricating oil and grease was similar compared to the Examples.

In conclusion, when the cleaning agent according various exemplary embodiments of the present invention is prepared using potassium glucarate as a main material, superior

TABLE 2

| | Example | | | | | Comparative Example | | | | | | | |
|---|---|---|---|---|---|---|---|---|---|---|---|---|---|
| Evaluation | 1 | 2 | 3 | 4 | 5 | 1 | 2 | 3 | 4 | 5 | 6 | 7 | 8 |
| Ability to remove oxide film layer | ○ | ○ | ○ | ○ | ○ | ○ | ○ | X | X | Δ | ○ | X | ○ |
| Ability to remove lubricating oil and grease | ○ | ○ | ○ | ○ | ○ | X | X | X | X | ○ | ○ | X | ○ |
| Extent of generation of offensive odor | 5 | 4 | 5 | 4 | 5 | 1 | 1 | 5 | 5 | 5 | 5 | 5 | 5 |

Evaluation method
The average score evaluated by 10 sensory test participants was applied.
Evaluation criteria (Ability to remove oxide film layer, lubricating oil and grease):
Upon observation the state of removal of the surface of the metal member with the naked eye,
Complete removal of oxide film layer (○)
Partially remaining oxide film layer (Δ)
Mostly remaining oxide film layer (X)
Evaluation criteria (Extent of generation of offensive odor):
Score 5: almost no odor is generated.
Score 4: slight odor is generated.
Score 3: moderate odor is generated.
Score 2: odor generation is somewhat severe.
Score 1: odor generation is very severe.

As is apparent from the test results, Examples 1 to 5 exhibited the same ability to remove an oxide film layer as Comparative Examples 1 and 2 using conventional sulfuric acid or hydrochloric acid.

As for the extent of generation of offensive odor, in Examples 1 to 5, using potassium glucarate, cleaning capability equivalent to Comparative Examples 1 and 2 was exhibited and almost no odor was generated.

In Comparative Examples 3 and 4, which did not use the chelating agent and the surfactant, the ability to remove the oxide film layer, lubricating oil and grease was significantly deteriorated, although the odor generation was not severe.

Comparative Examples 5 and 6 were conducted under the same test conditions as in Examples 1 and 2, except for the amount of EDTA as the chelating agent. In Comparative Example 5, the ability to remove the oxide film layer was cleaning capability may be obtained and odor generation may be minimized. Also, the wastewater generated after the cleaning process may suitably be managed.

Although various exemplary embodiments of the present invention have been described with reference to the accompanying drawings, those skilled in the art will appreciate that the present invention may be embodied in other specific forms without changing the technical spirit or essential features thereof. Thus, the exemplary embodiments described above should be understood to be non-limiting and illustrative in every way.

What is claimed is:

1. A cleaning agent composition for a metal member, comprising:

an organic acid derived from a monosaccharide, or a salt thereof;

a chelating agent;

a surfactant; and a solvent, and wherein the organic acid comprises a glucaric acid in which a potassium cation(K±) is present in the form of a salt at only one end, wherein the chelating agent is ethylenediamine tetraacetic acid.

2. The cleaning agent composition of claim 1, wherein the surfactant is a cationic surfactant.

3. The cleaning agent composition of claim 1, wherein the surfactant is a polyoxyethylene-based surfactant.

4. The cleaning agent composition of claim 1, wherein the surfactant is any one selected from the group consisting of polyoxyethylene alkylether, polyoxyethylene alkylphenylether and combinations thereof.

5. The cleaning agent composition of claim 1, wherein the surfactant is any one selected from the group consisting of dodecyltrimethylammonium bromide (DATB), cetyltrimethylammonium chloride (CTAC), hexadecylpyridinium bromide (HDPB), benzylcetyldimethylammonium chloride (BCDA), polyoxyethylene nonylphenyl ether and combinations thereof.

6. The cleaning agent composition of claim 1, wherein the cleaning agent comprises an amount of about 15 wt % to 30 wt % of the organic acid, or the salt thereof, an amount of about 0.8 wt % to 1.2 wt % of the chelating agent, an amount of about 0.2 wt % to 0.4 wt % of the surfactant and an amount of about 75 wt % to 85 wt % of the solvent based on the total weight of the cleaning agent composition.

7. A method of preparing a cleaning agent composition for a metal member, comprising:

producing a reaction admixture comprising a solvent, a monosaccharide and potassium hydroxide (KOH);

synthesizing an organic acid by reacting the reaction admixture with a metal catalyst in presence of oxygen gas; and preparing the cleaning agent comprising the organic acid, a chelating agent, a surfactant and the solvent, wherein the organic acid comprises a glucaric acid in which a potassium cation (K±) is present in the form of a salt at only one end, and wherein the chelating agent is ethylenediamine tetraacetic acid.

8. The method of claim 7, wherein the monosaccharide comprises one or more selected from the group consisting of glucose and galactose.

9. The method of claim 7, wherein the metal catalyst comprises a metal element supported on a support comprising one or more selected from the group consisting of carbon, silica, and alumina.

10. The method of claim 9, wherein the metal element comprises one or more selected from the group consisting of platinum, rhodium, palladium, and nickel.

11. The method of claim 7, wherein, the reaction mixture comprises the monosaccharide at a concentration of about 0.02 g/mL to 0.2 g/mL relative to the solvent.

12. The method of claim 7, wherein the reaction admixture comprises an amount of about 0.9 parts by weight to 1.5 parts by weight of the potassium hydroxide based on 100 parts by weight of the monosaccharide.

13. The method of claim 7, wherein an amount of about 0.3 parts by weight to 0.5 parts by weight of the metal catalyst based on an amount of the monosaccharide is reacted with the reaction admixture.

14. The method of claim 7, wherein the reaction admixture is oxidized at a pressure of about 1 bar to 5.0 bar and a temperature of about 30° C. to 50° C. for about 3 hr to 6 hr.

15. The method of claim 14, wherein a resulting product after the reacting has a hydrogen ion concentration of about pH 3 to pH 4.

* * * * *